US006776368B1

(12) United States Patent
Duncan et al.

(10) Patent No.: US 6,776,368 B1
(45) Date of Patent: Aug. 17, 2004

(54) PAPER TOWEL HOLDER

(75) Inventors: McKay Duncan, Brooklyn, NY (US); Kevin Williams, Brooklyn, NY (US)

(73) Assignee: Creative Bath Products, Inc., Central Islip, NY (US)

( * ) Notice: Subject to any disclaimer, the term of this patent is extended or adjusted under 35 U.S.C. 154(b) by 0 days.

(21) Appl. No.: 10/444,035

(22) Filed: May 22, 2003

Related U.S. Application Data

(60) Provisional application No. 60/448,156, filed on Feb. 14, 2003.

(51) Int. Cl.[7] ..... B65H 16/04
(52) U.S. Cl. ..... 242/597.7
(58) Field of Search ..... 242/597.7, 597, 242/597.1, 597.2, 597.3, 597.4, 597.5; 248/205.5, 205.8, 205.9

(56) References Cited

U.S. PATENT DOCUMENTS 3,240,461 A * 3/1966 Singleton ..... 248/205.8
4,012,007 A 3/1977 Cunningham
4,720,053 A * 1/1988 Vance ..... 242/597.7
5,076,527 A 12/1991 Yung-Huei
5,297,750 A 3/1994 Hunt
5,788,136 A * 8/1998 Othman ..... 242/597.7
5,842,655 A * 12/1998 McCarthy ..... 242/597.7
6,405,973 B1 6/2002 Hollinger
6,619,582 B1 * 9/2003 Jørgensen ..... 242/597.7

* cited by examiner

*Primary Examiner*—William A. Rivera
(74) *Attorney, Agent, or Firm*—Anthony J. Casella; Gerald E. Hespos

(57) ABSTRACT

A paper towel holder includes a base with a central aperture and a hollow spindle extending up from the base. A flexible disc is secured to the underside of the base and has a substantially flat bottom surface. A central aperture extends through the disc and communicates with the hollow interior of the spindle. A valve stem is slidably mounted in the spindle. The value stem will fall gravitationally into sealing engagement with portions of the disc surrounding the central aperture so that the central aperture is sealed. In this condition, any attempt to tilt or lift the paper towel holder will create a partial vacuum beneath the disc that will resist such lifting or tilting. However, the valve stem can be lifted up relative to the remainder of the towel holder to open the aperture in the disc. No partial vacuum will exist below the disc and the paper towel holder can be moved easily.

8 Claims, 4 Drawing Sheets

PAPER TOWEL HOLDER

This application claims priority on U.S. Provisional Patent Appl. No. 60/448,156, filed Feb. 14, 2003.

BACKGROUND OF THE INVENTION

1. Field of the Invention

The invention relates to a device for holding a roll of paper towels on a horizontal surface so that the paper towels can be dispensed efficiently and maintained neatly.

2. Description of the Related Art

Paper towels typically are wound onto a hollow cylindrical cardboard core that has an inside diameter of about 4 cm and a length of about 28 cm. An elongate strip of the paper towels is perforated, typically at 28 cm intervals, and is wound around the core. Thus, rectangular towels can be torn from the roll and used for a variety of household cleaning, drying and wiping chores.

Rolls of paper towels commonly are used in kitchens, and are stored and employed most frequently near a kitchen sink. Additionally, most households prefer to maintain the roll of paper towels in a neat and orderly fashion to enhance the aesthetic appearance of the kitchen. Accordingly, devices are widely employed for storing rolls of paper towels in a manner than enables rectangular sections of the paper towels to be separated from the roll as needed.

Households periodically will want to access paper towels at a location other than a location adjacent the sink. For example, it may be necessary to employ paper towels on a kitchen island where food is being prepared, at a dining counter in a kitchen or at other locations. Additionally, there may be instances where a household will want a kitchen to be especially attractive, and hence will not want the roll of paper towels to be present at all.

Some paper towel holders have a mounting panel and two end panels. The mounting panel has a length approximately equal to the length of the roll of paper towels and the end panels extend perpendicularly from the mounting panel. The end panels each include a central aperture configured to receive a spindle. Paper towel holders of this type are employed by permanently securing the mounting panel to an underside of a cabinet or to a wall so that the end panels project away from the cabinet or wall. The roll of paper towels is positioned between end panels with the central aperture through the core of the roll of paper towels aligned with the apertures through the end panels of the paper towel holder. The spindle then is passed through the first end panel, through the core of the roll of paper towels and then through the second end panel. Thus, the roll of paper towels is rotationally mounted under a cabinet or on a wall, and typically near a sink. This type of prior art paper towel holder functions well. However, many households would prefer not to mount a paper towel holder permanently to a cabinet or wall. Additionally, paper towel holders of this type do not permit the roll of paper towels to be moved from one location to another in a kitchen. Furthermore, paper towel holders of this type do not permit the paper towel holder to be removed from view.

Some paper towel holders are configured to mount vertically on a horizontal surface of a kitchen counter. These paper towel holders typically include a horizontal base with a diameter approximately equal to the diameter of a full roll of paper towels. A spindle projects centrally up from the base and is cross-sectionally dimensioned to telescope into the hollow core of the roll of paper towels. A simple paper towel holder of this type has two drawbacks. First, the free end of the roll of paper towels is likely to unwind partly from the roll and will provide an unsightly appearance. Additionally, forces exerted to tear a paper towel from the roll can tip the entire paper towel holder. The tipping of such a paper towel holder can damage glassware or other fragile items that might be on a kitchen counter. Additionally, such tipping presents an annoyance and inconvenience to the person working in the kitchen.

Several attempts have been made to prevent the above-described paper towel holder from tipping in response to forces generated during the separation of a paper towel from the roll. For example, U.S. Pat. No. 5,297,750 shows a paper towel holder with a plurality of suction cups mounted to the lower face of the base. Each suction cup includes a downwardly concave surface that can be pressed downwardly against a horizontal surface on a kitchen counter. These downward forces will urge air out from the volume beneath the suction cup. The suction cup then will resiliently return toward its initial position and create a low pressure region beneath each suction cup. The low pressure tends to hold the paper towel holder in position on the kitchen counter. However, a paper towel holder of this type is difficult to move for those situations when it is desired to have the paper towels at a different location in the kitchen.

U.S. Pat. No. 6,405,973 shows a paper towel holder with a single large suction cup mounted to the lower face of the base. The suction cup includes a downwardly concave surface that can be placed on the horizontal surface of the kitchen counter. The entire holder is then pushed down so that air initially trapped beneath the suction cup is urged outwardly. The suction cup then will resiliently return slightly toward its original position, and hence will create a low pressure region beneath the suction cup that holds a paper towel holder in place, in much the same manner as in U.S. Pat. No. 5,297,750. The suction cup of U.S. Pat. No. 6,405,973 also includes an upwardly projecting tab at an outer periphery of the suction cup. The tab can be gripped between a thumb and forefinger and lifted up to release the suction force. Thus, the towel holder can be moved. The towel holder shown in U.S. Pat. No. 6,405,973 also includes a side bar that extends parallel to the central spindle. The side bar is intended to minimize the unsightly unwinding of the free end of the roll of paper towels. The towel holder shown in U.S. Pat. No. 6,405,973 can be difficult to release from the supporting surface when the roll of paper towels is full or nearly full. In particular, the tab is very near the outer periphery of the roll of paper towels and hence can be difficult to grip conveniently. Furthermore, the tab projecting up through the base of the paper towel holder shown in U.S. Pat. No. 6,405,973 is an obtrusive appendage to an otherwise streamlined configuration. Additionally, the side bar shown in U.S. Pat. No. 6,405,973 is effective for neatly holding the free end of the roll of paper towels when the roll is full. However, the side bar is less effective when the roll of paper towels is partly depleted. Additionally, the device shown in U.S. Pat. No. 6,405,973 requires the inconvenient downward pushing on the device to activate the suction mechanism. The holder shown in U.S. Pat. No. 6,405,973 would not work well if the user did not push the entire holder down sufficiently or if the user forgot to push the holder down.

U.S. Pat. No. 4,012,007 shows a suction-mounted paper towel holder that does not require the downward pushing of the entire holder to activate the suction mechanism. Rather, the spindle of the device shown in U.S. Pat. No. 4,012,007 includes a movable section that is attached to the suction cup. The movable section can be rotated and cooperates with a helical cam surface to pull the center of the suction cup up. This upward movement of the center part of the suction cup creates a low pressure that holds the suction cup in place. The suction forces can be released by rotating the movable member in the opposite direction to lower the center of the suction cup. The required rotation of the movable member to activate the suction cup is an inconvenience.

U.S. Pat. No. 5,076,527 shows a suction device that can be adapted to a plurality of different articles that require secure retention on a horizontal surface, but also require movement periodically. In particular, U.S. Pat. No. 5,076,527 provides a downwardly concave suction device mounted to the underside of the article that requires support. The suction device includes at least one aperture at a central position for providing air communication to the concave region beneath the suction device. The article that requires support is movably mounted relative to the suction device between a lower position where the article blocks the aperture through the suction device and an upper position where the article opens: the aperture. This device is employed by mounting the concave face of the suction device on the horizontal surface and then pushing the article down. The downward movement simultaneous closes the aperture in the suction device and forces air transversely out of the suction device. The suction device then will resiliently return toward an undeflected condition, but will remain in close contact with the article that is being supported. Hence, the aperture through the suction device remains closed and a low pressure is created beneath the suction device to hold the article securely on the supporting surface. The article can be moved merely by lifting the article up relative to the suction device. This upward movement of the article opens the aperture through the suction device and releases the suction force that held the article in place. The device shown in U.S. Pat. No. 5,076,527 works well for those types of articles that are conveniently lifted. However, some articles do not provide convenient region that can be gripped and lifted to release a suction force. Additionally, the device shown in U.S. Pat. No. 5,076,527 requires the inconvenient downward pushing on the device to activate the suction mechanism.

The downwardly concave suction devices shown in the above-described patents all are used in a condition where the resilient material of the suction cups is urging the entire device away from the supporting surface. Additionally, these suction devices will flex during each removal of a paper towel. These inherent resilient biasing forces of the suction devices when combined with the periodic flexing of the suction devices will cause minute amounts of air to seep into the space between the supporting surface and the suction device. Hence, the supporting forces of the suction devices will gradually weaken over time.

In view of the above, it is an object of the subject invention to provide a device for securely holding an object to a horizontal surface, such as a kitchen counter.

It is a particular object of the subject invention to provide a paper towel holder that will securely hold the roll of paper towels in a selected position on a horizontal surface.

It is another object of the subject invention to provide a paper towel holder that does not require a downward force to be activated.

It is a further object of the subject-invention to provide a paper towel holder that can be moved easily from one location to another on a horizontal supporting surface.

It is still a further object of the subject invention to provide a paper towel holder that will neatly contain the free end of a roll of paper towels regardless of the number of paper towels that remain on the roll.

SUMMARY OF THE INVENTION

The invention relates to a paper towel holder with a base having opposite top and bottom faces and an aperture extending continuously between the top and bottom faces. The base preferably is formed from a substantially rigid material, such as a molded synthetic resin. The bottom face of the base may be substantially concave. In a preferred embodiment, the base includes a generally planar top wall that includes the top face of the base. A generally cylindrical skirt may extend down from the top wall concentrically with the aperture.

The holder further includes a rigid generally tubular spindle that extends upwardly from the top face of the base. The tubular spindle preferably defines an outside cross-sectional dimension less than the inside cross-sectional dimension of a roll of paper towels. The tubular spindle further defines a length approximately equal to the typical length of a roll of paper towels. The tubular spindle includes a hollow interior extending continuously from the top end to the bottom end of the spindle. The hollow interior of the tubular spindle communicates with the aperture in the base of the paper towel holder.

The paper towel holder further includes a thin flexible disc with opposite top and bottom surfaces and a central aperture extending between the top and bottom surfaces. The disc includes an outer periphery that may substantially conform to the external dimensions of the base of the paper towel holder. The bottom face of the disc is substantially planar across a major portion of the surface regions extending from the outer periphery toward the central aperture. However, the bottom surface of the disc may include a small concave region close to and surrounding the central aperture. The upper surface of the disc is substantially planar or slightly convex at locations extending inwardly from the outer periphery of the disc. Any such slightly convex configuration for the upper surface of the disc is attributable to a slightly greater thickening of the disc at locations closer to the central aperture through the disc. A generally cylindrical collar projects upwardly from the upper surface of the disc at locations near the central aperture through the disc. The collar has a greater thickness than parts of the disc closer to the outer periphery. Hence, the collar is at least somewhat rigid. The extreme upper end of the collar preferably is substantially planar and circularly generated. A valve seat is defined between the collar and the central aperture. The upper surface of the disc may further include a short frustum-shaped section surrounding the collar.

Portions of the upper surface of the disc surrounding the mounting collar are securely affixed to the lower face of the base so that the central aperture through the disc communicates with the central aperture through the base and with the hollow center of the tubular spindle. Portions of the disc extending a substantial part of the distance inwardly from the outer periphery toward the collar are sufficiently thin to exhibit flexibility in response to forces exerted on the disc. Additionally, the substantially planar lower surface of the disc preferably is very smooth to provide good surface-to-surface contact with a smooth supporting surface, such as the supporting surface of a kitchen countertop.

The paper towel holder further includes an elongated valve stem having opposite top and bottom ends. The valve stem is disposed slidably in the tubular spindle for at least limited axial movement therein. A valve surface is defined at or near the bottom end of the valve stem and is configured for sealing engagement with the valve seat on the disc when the valve stem is in its lower position relative to the tubular spindle of the paper towel holder. However, the valve surface of the valve stem is spaced above the valve seat on the disc when the valve stem is in its upper position. The top end of the valve stem preferably is disposed above the top end of the tubular spindle to facilitate manual gripping and movement of the valve stem relative to the tubular spindle.

The paper towel holder may further include a towel stop hingedly mounted to the base and biased into a position toward the tubular spindle.

The paper towel holder is employed by rotating the stop away from the tubular spindle and then telescoping a roll of paper towels over the tubular spindle. The paper towel stop then is permitted to move resiliently toward the outer layer of paper towels on the roll so that the towel stop engages at least part of the outer layer for holding the outer layer of paper towels closely against inner layers, and thereby preventing an unsightly unwinding of paper towels from the roll. The assembly of the paper towel holder and a roll of paper towels then is merely, supported on a generally horizontal supporting surface, such as a kitchen countertop. In this position, the lower surface of the disc assumes its natural substantially flat state across a major portion of the bottom surface of the flat disc. Thus, the bottom surface of the; flat disc is disposed substantially in face-to-face contact with the supporting surface. In this condition, there is no active gripping force between any part of the paper towel holder and the supporting surface. As a result, a horizontal force exerted on the paper towel holder may permit the paper towel holder to slide horizontally on the supporting surface.

Paper towels can be removed from the paper towel holder merely by pulling the free end of the roll of paper towels generally horizontally and then pulling the paper towels downwardly to sever a towel or a plurality of towels from the remainder of the roll along a perforation line. Forces generated by pulling on the paper towels are in a direction that could tend to tip the paper. towel holder. However, such forces will not affect the position of the valve stem relative to the disc. Hence, the valve surface of the valve stem will remain in sealing contact with the valve seat of the disc. As a result, a slight tipping or lifting of the paper towel holder will cause the base to tilt or lift and will elevate the center portion of the flexible disc upwardly relative to the supporting surface. However, outer peripheral regions of the disc are very flexible, and hence will remain in contact with the supporting surface. Consequently the volume beneath the flexible disc will increase without directing additional air into the volume beneath the disc. Accordingly, a low pressure condition will exist beneath the disc, and the lower pressure will resist and/or prevent the tipping or lifting of the paper towel holder. Accordingly, the paper towel holder is highly stable.

The paper towel holder can be moved readily from one location to another merely by gripping the valve stem at a location adjacent the top end of the tubular spindle and slightly above the top end of the roll of paper towels mounted on the paper towel holder. The valve stem then is lifted to separate the valve face of the valve stem from the valve seat of the disc. Accordingly, the region of the paper towel holder beneath the disc is placed in communication with the ambient air pressure in areas between the tubular spindle and the valve stem. Thus, there is no low pressure region pulling the paper towel holder down, and the paper towel holder can be lifted easily for repositioning.

DETAILED DESCRIPTION OF THE PREFERRED EMBODIMENTS

Figure 1:
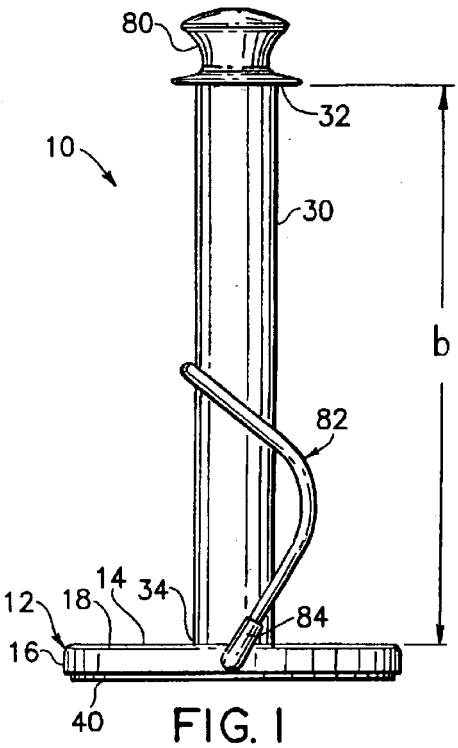
FIG. 1 is a side elevational view of a paper towel holder in accordance with the subject invention.
Figure 2:
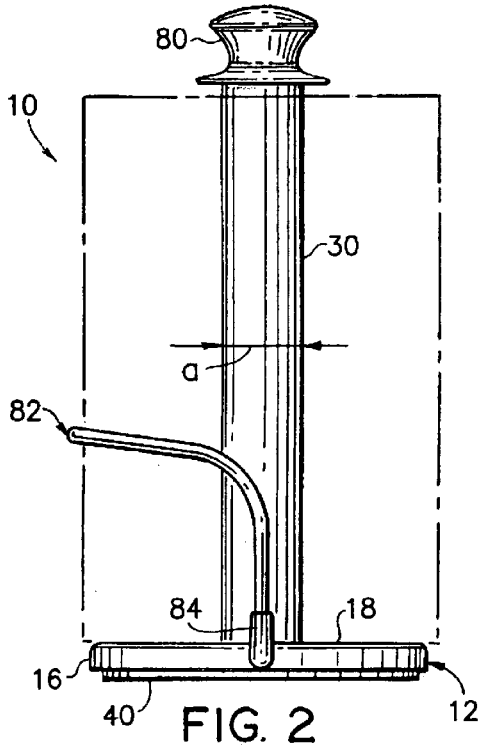
FIG. 2 is a side elevational view similar to FIG. 1, but showing a roll of paper towels mounted to the paper towel holder.
Figure 3:
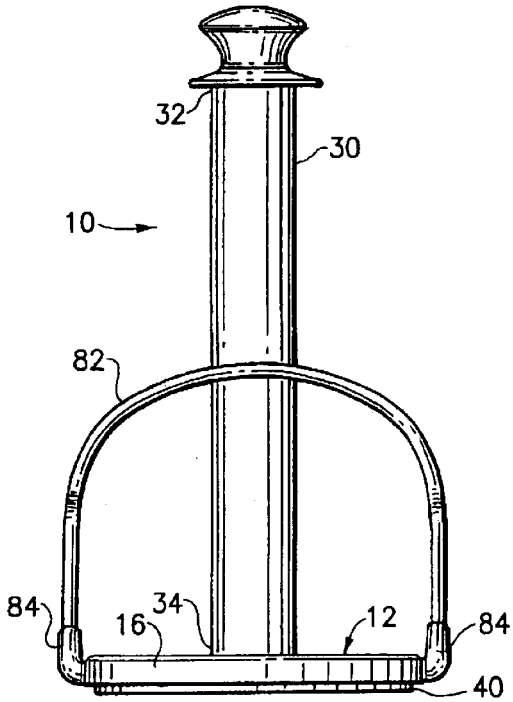
FIG. 3 is a front elevational view of the paper towel holder.
Figure 4:
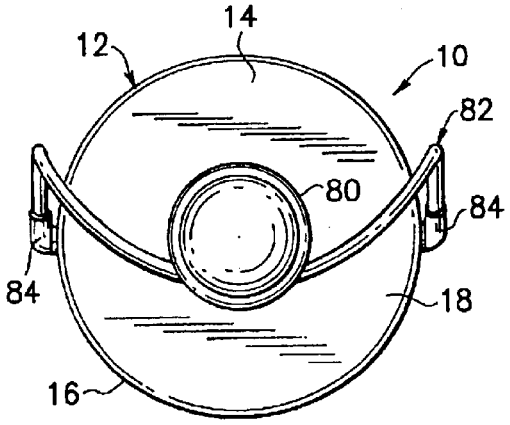
FIG. 4 is a top plan view of the paper towel holder.
Figure 5:
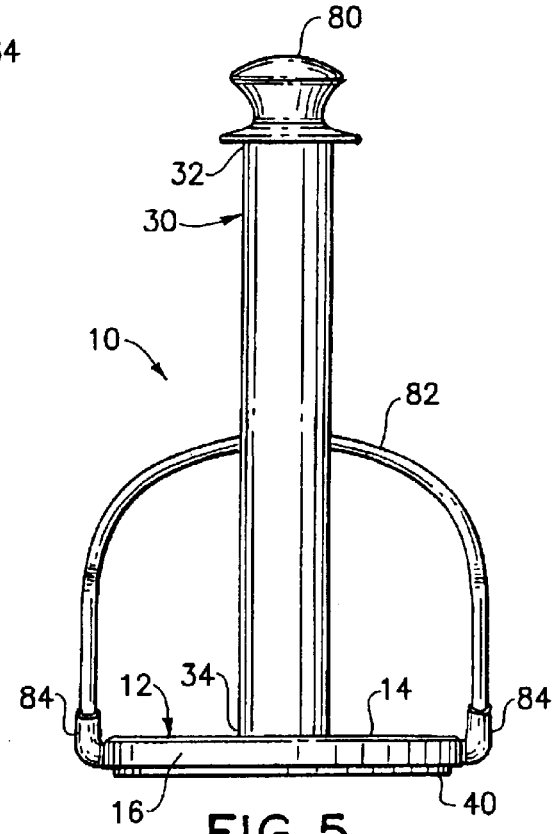
FIG. 5 is a rear elevational view of the paper towel holder.
Figure 6:
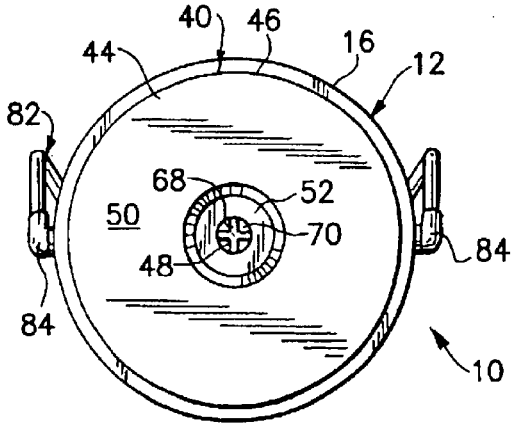
FIG. 6 is a bottom plan, view of the paper towel holder.
Figure 7:
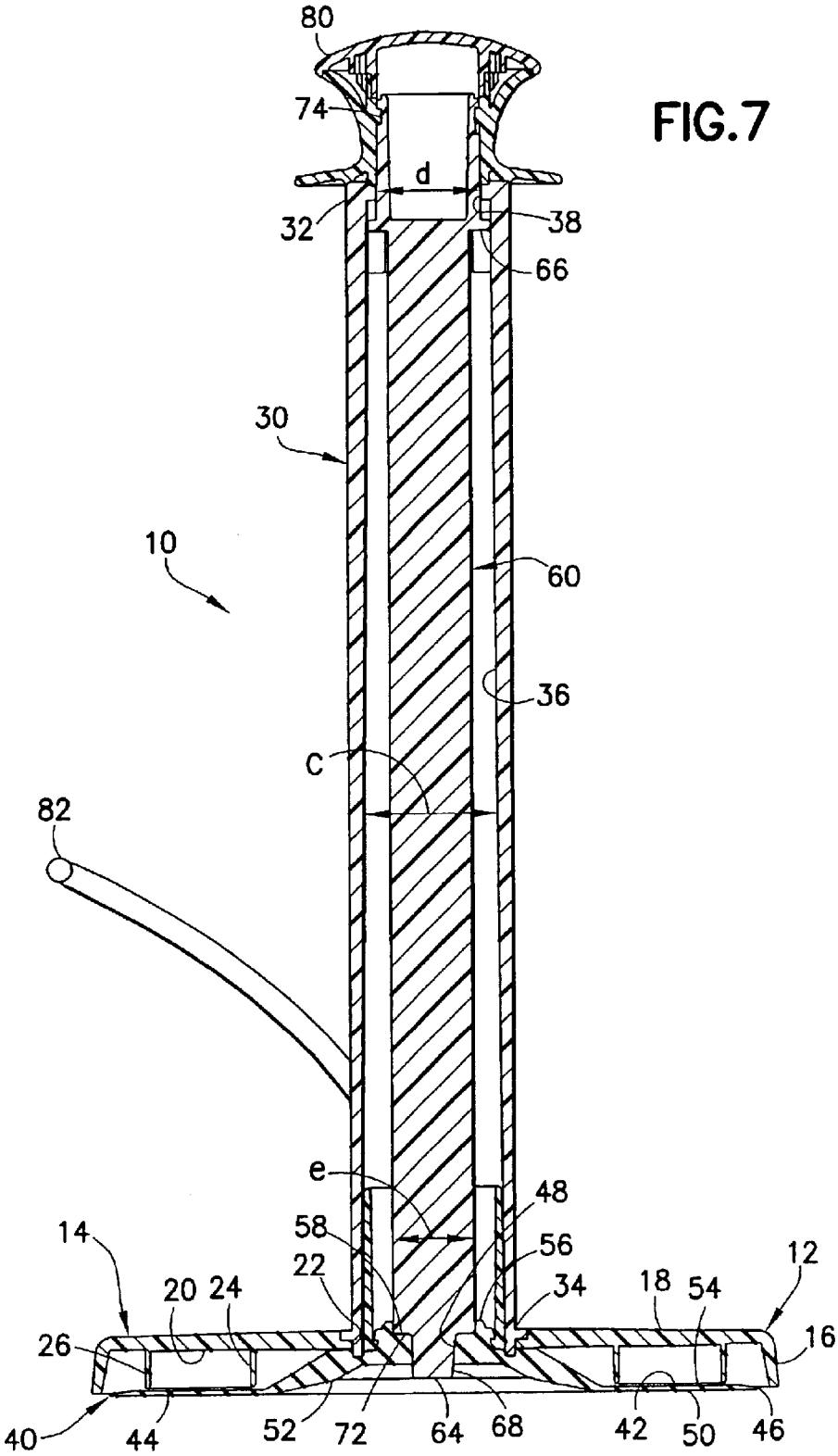
FIG. 7 is a cross-sectional view taken along line 7—7 in FIG. 3 and showing the actuator in seating engagement with the flexible disc.
Figure 8:
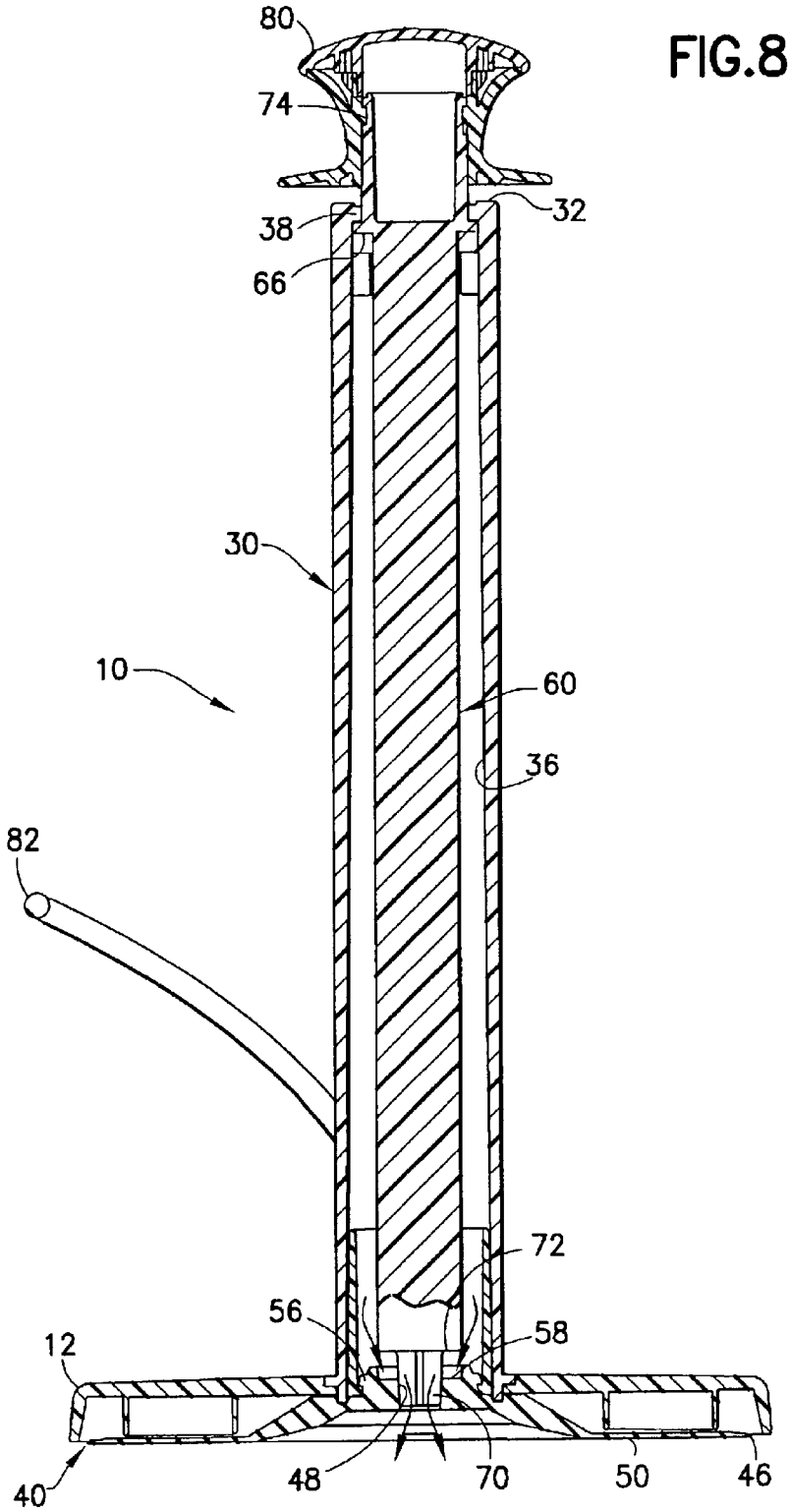
FIG. 8 is a cross-sectional view similar to FIG. 4, but showing the actuator in a different position relative to the tubular support.

A paper towel holder in accordance with the subject invention is identified generally by the numeral 10 in FIGS. 1–5. The paper towel holder 10 includes a base 12 unitarily molded from a rigid plastic material and including a generally planar circular top wall 14 and a generally cylindrical skirt 16 that extends down from the top wall 14. The top wall includes a top surface 18, a bottom surface 20 and a central aperture 22 that extends between the top and bottom surfaces 18 and 20. Inner and outer cylindrical support walls 24 and 26 extend down from the bottom surface 20 of the top wall 14 and are disposed substantially concentrically to both the central aperture 22 and the skirt 16. The support walls 24 and 26 contribute to the structural support for the base 12.

The paper towel holder 10 further includes a hollow substantially cylindrical spindle 30 with a top end 32, a bottom end 34 and a cylindrical passage 36 extending between the ends. The bottom end 34 of the spindle 30 is mounted securely to the central top wall 14 of the base 12 at a location concentric to the central aperture 22 in the top wall 14. Thus, the passage 36 through the spindle 30 communicates with the aperture 22 through the base 12. The spindle 30 defines an outside diameter "a" that is less than the inside diameter of the core about which paper towels are rolled. The spindle 30 further defines a length "b" measured from the top surface 18 of the base 12 to the top end 32 of the spindle 30 that substantially equals the length of the core about which the paper towels are rolled. In the preferred embodiment, the length "b" is approximately 28 cm. The passage 36 through the spindle 30 defines an inside diameter "c" for a major portion of the length of the spindle 30. However, the spindle 30 is characterized by an inwardly extending flange 38 adjacent the top end 32. The flange 38 defines an inside diameter "d" that is less than the inside diameter "c" at other locations along the passage 36.

The paper towel holder 10 further includes a disc 40 formed from a soft PVC. A preferred PVC has a durometer reading of 70 Shore A and a density of approximately 1.2 g/cm$^3$. The disc 40 has a top surface 42, a bottom surface 44 and a substantially circular outer periphery 46. A central aperture 48 extends through the disc 40 from the top surface 42 to the bottom surface 44 at a location concentrically disposed with respect to the circular outer periphery 46. The bottom surface 44 includes a substantially planar section 50 that extends inwardly from the outer periphery 46 a major portion of the radial distance toward the central aperture 48. In a preferred embodiment, the planar section 50 of the bottom surface 40 extends inwardly from the outer periphery 46 a distance equal to at least about 60% of the radial dimension of the disc 40. The bottom surface 44 further includes a generally frustum-shaped concave region 52 that extends between the planar surface 50 and the central aperture 48.

The top surface 42 of the disc 40 also includes a substantially flat section 54 that extends a major portion of the distance inwardly from the outer periphery 46. The substantially flat section 54 can be nearly perfectly planar or generated as a very shallow cone. With the later option, the thickness dimension of the disc 40 will increase slightly from the outer periphery 46 toward inner regions on the substantially flat section 54 of the top surface 42. The distance between the substantially planar section 50 of the bottom surface 44 and the substantially flat section 54 of the top surface 42 is sufficiently small so that these regions of the disc 40 are easily flexible. Additionally the molding of the disc 40 preferably is carried out so that the planar section 50 is very smooth for achieving good surface-to-surface contact with a correspondingly smooth supporting surface.

A short tubular collar 56 with an inside diameter "e" extends up from the top surface 42 concentrically with the central aperture 48 through the disc 40. The collar 56 is dimensional to fit in the central aperture 22 through the top wall 14 of the base 12. A valve seat 58 extends between the central aperture 48 in the disc 40 and the tubular collar 56. The valve seat 58 is substantially planar and substantially parallel to the planar surface 50 on the bottom of the disc 40. Portions of the top surface 42 between the collar 56 and the substantially flat section 54 define a frustum with a greater thickness and more rigidity than outer peripheral regions of the disc 40.

The paper towel assembly 10 further includes an elongate valve stem 60. The valve stem 60 has a top end 62 and a bottom end 64. The valve stem 60 is slidably received in the passage 36 of the spindle 30 for limited vertical movement within the passage 36. The valve stem 60 includes an outwardly extending flange. 66 near the top end 62. The flange 66 defines an outside diameter that is less than the inside diameter "c" of the passage 36 through the spindle 30, but greater than the inside diameter "d" defined by the flange 38 at the top end 32 of the center support 30. As a result, the valve stem 60 can slide through a limited upward range of movement within the passage 36 until the outwardly extending flange 66 on the valve stem 60 abuts the inwardly extending flange 38 on the center support 30.

A tip 68 is defined adjacent the bottom end 64 of the valve stem 60 and is cross-sectionally dimensioned to telescope into the passage 48 through the disc 40. However, the tip 48 does not include a smooth cylindrical outer surface. Rather, the tip 68 is characterized by a plurality of axially extending passages 70 in the outer surface. A circular valve wall 72 projects outwardly from the tip 68 and includes a generally planar surface aligned substantially perpendicular to the axis of the valve stem 60. The circular wall 72 defines an outside diameter equal to or slightly less than the inside diameter "e" of the tubular collar 56 on the disc 40. As a result, the valve wall 72 can be telescoped into a collar 56 and can sealingly engage the valve seat 58 on the top surface of the disc 40. Portions of the valve stem 60 between the valve wall 72 and the flange 66 are cross-sectionally smaller than the passage 36 through the center spindle 30. Additionally, these portions of the valve stem 60 between the valve wall 72 and the flange 66 are not cylindrical and include a plurality of axial extending passages. As a result, a substantial volume of air exists between the center support 30 and the valve stem 60.

The valve stem 60 includes mounting structure 74 at locations adjacent the top end 62. In a preferred embodiment, the mounting structure 74 has two diametrically opposed L-shaped channels that form a bayonet-type connection. However, other types of connections can be provided.

The paper towel holder 10 further includes an actuator handle 80 that is telescoped over the top end 62 of the valve stem 60 and releasably engaged with the mounting structure 74 thereon. The actuator handle 80 defines a shape convenient for gripping and manipulation and has an outside cross-sectional dimension that exceeds the inside diameter of the core for a roll of paper towels.

The paper towel holder 10 further includes a generally U-shaped gate 82 having opposed ends 84 that are hinged to diametrically opposed positions on the cylindrical skirt 16 of the base 12. Additionally, springs (not shown) are provided for biasing the gate 82 upwardly and toward the center spindle 30.

The paper towel holder 10 is assembled by first telescoping the top end 62 of the valve stem 60 into the bottom end 34 of the center spindle 30. This upward telescoped movement of the valve stem 60 in the center spindle 30 terminates when the flange 66 of the valve stem 60 abuts the inward flange 38 of the center spindle 30. In this position, the extreme top end 62 of the valve stem 60 projects up beyond the top end 32 of the center support 30. The actuator handle then may be engaged with the mounting structure 74 adjacent the top end 62 of the valve stem 60. The actuator handle 80 is cross-sectionally larger than the inside diameter "d" of the inward flange 38 of the center support 30. Hence, the actuator handle 80 limits downward telescoped movement of the valve stem 60 within the center support 30.

Portions of the top surface 42 of the disc 40 disposed outwardly from the collar 56 then are secured to portions of the bottom surface 20 of the top wall 14 of the base 12 so that the central aperture 48 through the disc 40 is concentric with the central aperture 22 in the base 12. In this position, the mounting collar 58 projects slightly into the passage 36 of the center spindle 30 adjacent the bottom end 34 thereof.

The paper towel holder 10 can be employed merely by gently placing the bottom surface 44 of the disc 40 on a flat relatively smooth surface, such as a kitchen countertop. The relatively smooth flat section 50 of the bottom surface 44 of the disc 40 will achieve good surface-to-surface contact with the supporting surface, such as the kitchen countertop. In this position, the valve stem 60 will be urged gravitationally downward so that the tip 68 adjacent the bottom end 64 of the valve stem 60 telescopes into the aperture 48 through the disc. Additionally, the valve wall 72 adjacent the tip 60 will sealingly engage the valve seat 58 of the disc 40 at locations inwardly from the collar 56.

A roll of paper towels can be mounted to the paper towel holder 10 merely by separating the actuator handle 80 from the valve stem 60 and then telescoping the core of the paper towel roll over the top end 32 of the center spindle 30. The gate 82 will have to be rotated against the biasing forces of the springs so that the bottom end of the roll of paper towel can be seated adjacent the top surface 18 of the top wall 14. The gate 82 then can be released, and the biasing forces of the springs will urge the gate 82 into engagement with the outer layer of the roll of paper towels. The actuator handle 80 then can be mounted again onto the top end 62 of the valve stem 60.

No downward force is required to actuate a secure gripping of the paper towel holder 10 with the supporting surface. In fact, any downward force that might be applied would be transferred from the inner and outer cylindrical walls 24 and 26 to the substantially flat top surface 42 of the disc 40. The cylindrical walls 24 and 26 align with the planar section 50 of the bottom surface 44, and hence any downward forces would not cause any significant change in shape of the disc 40. A transverse force perpendicular to the axis of the center spindle 30 could be exerted on the paper towel holder and the roll of paper towels to slide the paper towel holder 10 from one location to another on a supporting surface.

Paper towels may be dispensed from the paper towel holder 10 by merely grabbing the free end of the paper towel roll, pulling a selected number of panels from the roll and then urging the free end of the paper towels down relative to the paper towel holder 10. These forces will generate a moment on the paper towel holder 10 that conceivably could tip a conventional paper towel holder. However, any such moment will cause a lifting and/or tilting of the base 12 and center spindle 30. However, the thin regions of the disc 40 inwardly from and adjacent to the outer periphery 46 of the disc 40 are very flexible and will remain in contact with the supporting surface as the more rigid components of the paper towel holder 10 start to move. As a result, the volume beneath the disc 40 will increase significantly beyond the small volume provided by the concave frustum-shaped section 52. The increase in volume without a corresponding increase in air will create a partial vacuum that will resist the tilting forces generated in response to the tearing of a paper towel from the roll. As a result, the paper towel holder 10 will not tip completely. In a similar manner, the paper towel holder 10 near a work area of a kitchen could be struck inadvertently by an arm, hand, platter or kitchen tool being moved near the work area. Such contact also will generate moments that could tip a conventional paper towel holder and cause damage to nearby glassware or dishes. However, the above-described partial vacuum will be created in response to such inadvertent contact and will prevent the paper towel holder 10 from tipping.

The paper towel holder 10 will have to be moved from time-to-time for cleaning the countertop or for paper towel holder in a location where the paper towels are needled. Such movement of a conventional suction cup mounted appliance can be complicated and may require manipulation of peripheral regions of the suction cup. In this instance, however, it is merely necessary to grip the actuator handle 80 and exert a slight upward lifting force. These forces will cause the valve stem 60 to move up and away from the valve seat 58. As a result, the area beneath the disc 40 is exposed to ambient pressure conditions. The upward movement of the valve stem 60 will end when the outward flange 66 on the valve stem abuts the inward flange 38 on the center spindle 30. Hence, further lifting forces on the actuator handle 80 will enable the relatively light paper towel holder 10 to be lifted from the supporting surface and relocated to a more preferred position.

What is claimed is:

1. A paper towel holder, comprising:

a base with opposite top and bottom faces and a central aperture extending through the base;

a substantially flat flexible disc secured to the bottom surface of the base and having a central aperture extending therethrough and communicating with the aperture in the base, the disk having an outer periphery and a bottom surface, the bottom surface including a substantially planar section extending inwardly from the outer periphery a major portion of a distance between the outer periphery and the central aperture;

a center support mounted to the base and extending upwardly therefrom; and a valve stem movably disposed relative to the base, the disc and the center support for movement from a first position where said valve stem seals said aperture through said disc and a second position where said valve stem opens said aperture in said disc.

2. The paper towel holder of claim 1, wherein the disc has a selected radius, and wherein the planar section of the bottom surface of the disc extends inwardly from the outer periphery of the disc for a distance at least approximately 60% of the radius.

3. The paper towel holder of claim 1, wherein the flat flexible disc has a top surface the base and an annular valve seat inwardly from the aperture in the base and surrounding the aperture in the disc, the valve stem having a lower end configured for engaging said valve seat of said disc.

4. The paper towel holder of claim 3, wherein the top of the disc includes an annular collar surrounding the valve seat, the valve stem being dimensioned for telescoped engagement in the collar of the disc.

5. The paper towel holder of claim 1, wherein said valve stem has a tip dimensioned for telescoping into the aperture in the disc when the valve stem is in the first position, the tip including a plurality of channels for permitting flow of air when the valve stem is in the second position.

6. A paper towel holder, comprising:

a base with opposite top and bottom faces and a central aperture extending through the base;

a substantially flat flexible disc secured to the bottom surface of the base and having a central aperture extending therethrough and communicating with the aperture in the base;

a center support mounted to the base and extending upwardly therefrom; and a valve stem movably disposed relative to the base, the disc and the center support for movement from a first position where said valve stem seals said aperture through said disc and a second position where said valve stem opens said aperture in said disc, wherein the paper towel holder is for holding a roll of paper towels wound onto a core, the core having a selected length, the center support of the paper towel holder having a length substantially equal to the length of the core of the roll of paper towels, the valve stem having an end remote from said disc projecting beyond the end of the center support to enable manipulation of said valve stem.

7. A paper towel holder wherein, comprising:

a base with opposite top and bottom faces and a central aperture extending through the base, the bottom surface of the base includes at least one downwardly extending circumferential wall;

a substantially flat flexible disc secured to the bottom surface of the base and having a central aperture extending therethrough and communicating with the aperture in the base, the disc having a top surface and the circumferential wall of the base contacting the top surface of the disc;

a center support mounted to the base and extending upwardly therefrom; and a valve stem movably disposed relative to the base, the disc and the center support for movement from a first position where said valve stem seals said aperture through said disc and a second position where said valve stem opens said aperture in said disc.

8. A paper towel holder, comprising:

a base with opposite top and bottom faces and a central aperture extending through the base;

a substantially flat flexible disc secured to the bottom surface of the base and having a central aperture extending therethrough and communicating with the aperture in the base;

a center support mounted to the base and extending upwardly therefrom;

a valve stem movably disposed relative to the base, the disc and the center support for movement from a first position where said valve stem seals said aperture through said disc and a second position where said valve stem opens said aperture in said disc; and a generally U-shaped spring-biased gate pivotally mounted to diametrically opposite positions on said base and biased toward the center support.

* * * * *